United States Patent [19]

Niemeijer

[11] 4,190,523

[45] Feb. 26, 1980

[54] RADIAL MULTIHYDROCYCLONE

[75] Inventor: Klaas B. Niemeijer, Veendam, Netherlands

[73] Assignee: Koninklijke Scholten-Honig N.V., Amsterdam, Netherlands

[21] Appl. No.: 877,551

[22] Filed: Feb. 13, 1978

[30] Foreign Application Priority Data

Feb. 17, 1977 [NL] Netherlands ..... 7701686

[51] Int. Cl.[2] ..... B04C 5/28

[52] U.S. Cl. ..... 209/211; 210/512 M

[58] Field of Search ..... 209/211, 144; 210/510 M; 55/349

[56] References Cited

U.S. PATENT DOCUMENTS

| | | | |
|---|---|---|---|
| 2,671,560 | 3/1954 | Fontein et al. | 209/211 |
| 2,956,679 | 10/1960 | Hoffmann | 209/144 |
| 3,335,860 | 8/1967 | Baxter | 209/211 |
| 3,959,123 | 5/1976 | Wikdahl | 210/512 M X |

*Primary Examiner*—Ralph J. Hill

*Attorney, Agent, or Firm*—O'Brien & Marks

[57] ABSTRACT

A radial multihydrocyclone provided with a plurality of superimposed flat discs made by moulding whereby in each disc there is recessed a plurality of radially oriented cyclones which with their drain ends open into a central passage in the disc and with their overflow end are positioned in the circumferential zone of the disc, while the two sides of the disc are interconnected by at least one eccentric passage, while for each cyclone in the disc a tangential supply duct is in communication with a common recess in the disc.

3 Claims, 2 Drawing Figures

RADIAL MULTIHYDROCYCLONE

Figure 1:
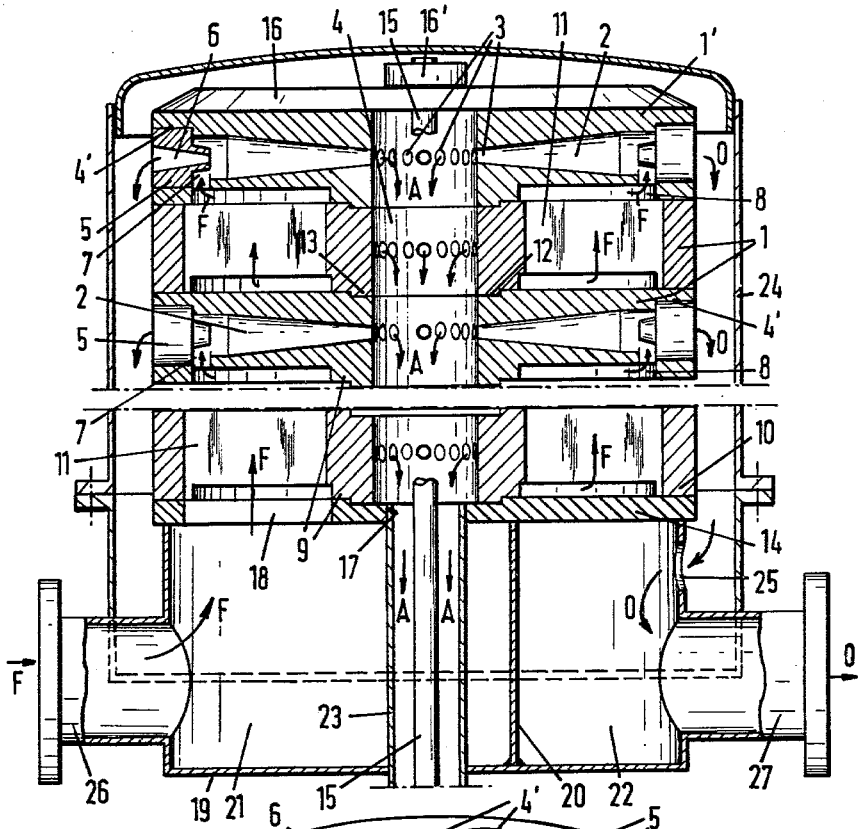

The present invention relates to a radial multihydrocyclone, in which the individual cyclones are arranged within a casing at superimposed levels and radially at each level, the drain openings for all cyclones ending in a common central discharge duct, the overflow pipes of all cyclones ending in a common space surrounding the entire cyclone assembly, while a supply duct system is disposed for the individual cyclones.

Such a radial multihydrocyclone is known from U.S. Pat. No. 2,956,679, in which the individual cyclones are mounted in a casing wherein the central discharge space is isolated relatively to the annular space which functions as storage space for the overflows. For the supply to the separate cyclones use is made of a central supply line branching into separate lines that lead to the tangential inlets of the separate cyclones.

It will be clear that the assembly of such a radial multihydrocyclone is very complicated and time consuming, in particular when large numbers, e.g. 150–200 cyclones are concerned. The accessibility of the separate cyclones, for instance for cleaning or repair purposes moreover is limited.

It is the object of the invention to eliminate said drawbacks.

To this effect the multihydrocyclone according to the present invention comprises an assembly of a plurality of superimposed flat discs made by casting, each disc having a number of radially oriented cyclones recessed therein, which with their drain ends open into a central passage in the disc while their overflow ends are disposed in the peripheral zone of the disc, while the two sides of the disc are interconnected by at least one eccentric passage and there being recessed a circular cavity around and spaced apart from the central passage at least at one side of the disc, whereby for each cyclone in the disc a tangential supply duct is in communication with said cavity.

The radial multihydrocyclone according to the invention can be very simply assembled, viz. by stacking onto each other a variable number of discs, depending on the capacity, while pressing said discs properly against each other. The central passages in the disc then constitute the common discharge duct for the drain fraction. The overflow fractions, as in the prior art radial multihydrocyclone, open into the circumference and the eccentric passages in the discs, together with the cavities in the disc sides extending about the central passage, constitute the supply duct system. For the material to be treated in the cyclones is introduced at one side of the thus formed cyclone block, each time filling the cavity around the centre at one side of the disc, then passing said disc via the eccentric passage while subsequently filling the corresponding circular cavity in the next disc, etc. From the circular cavities the material is introduced in the cyclones via the tangential supply ducts.

With stacked discs, the central discharge duct is automatically isolated relative to the collecting space for the overflow fraction, positioned between the radial exterior of the discs assembly and the casing of the multihydrocyclone. Sealing problems which may occur in the prior art are absent here, consequently.

In order to simplify the casting of the discs, there may be present a recess, in a further embodiment of the invention, adjacent the circumference of the disc, in the extension of each cyclone, as continuation of the widest portion of the funnel-shaped cyclone chamber for taking up an insert piece constituting an overflow pipe, the so-called cover plate.

Said cover plates may however be kept in place in any other desired manner by adhesives.

According to the invention the discs may be moulded from a polymer material with the conventional aggregates as fillers, for instance polyurethane resins or polyepoxy resins. Preference is given to a polyurethane resin, inter alia on account of the high abrasion resistance of this material.

It is observed that U.S. Pat. No. 2,956,679 mentions the possibility to manufacture the whole group of hydrocyclones as an integral block, for instance by moulding synthetic material, such as rubber. Since within such a block the duct assembly for material supply to the individual cyclones has to be formed, considerable technical moulding problems will have to be solved. The idea underlying the present invention to construct a radial multihydrocyclone from stacked discs cannot be derived from this publication.

Figure 2:
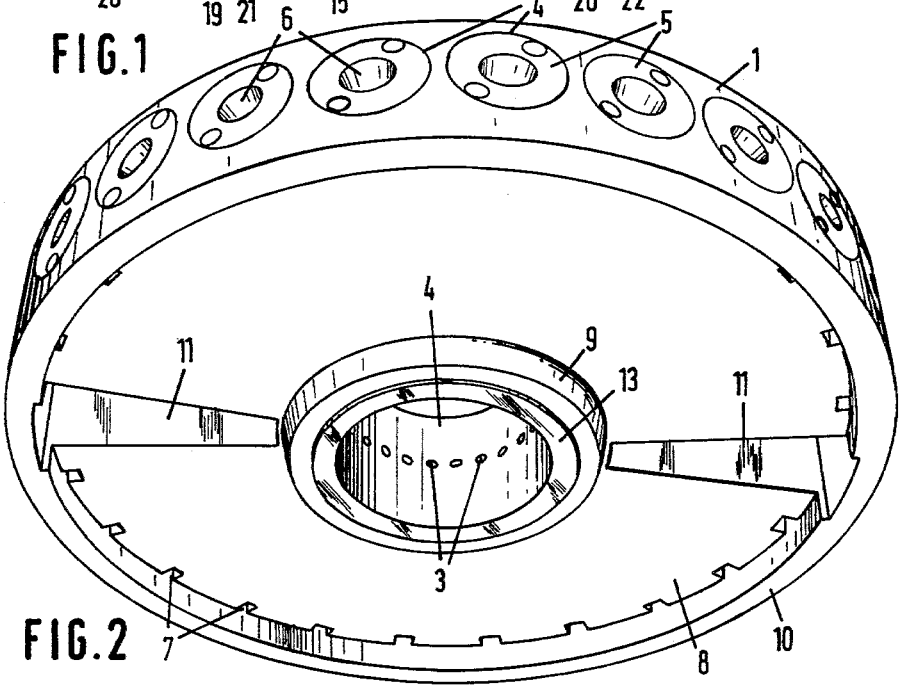

One embodiment of the radial multihydrocyclone according to the invention will now be described, by way of example, with reference to the accompanying drawing, in which FIG . 1 is a diagrammatic axial cross-section partly in side view, of the radial multihydrocyclone and FIG. 2 is a perspective view of one of the discs of which the multihydrocyclone is substantially composed.

As shown in FIG. 1 the radial multihydrocyclone is composed of a plurality of stacked discs 1, the top disc 1' of which may have a slightly deviating configuration.

In each disc 1 which is made by moulding, there is recessed a plurality of radial cyclones 2, of which the narrow drain end 3 opens into a central passage 4 in the disc. At the circumference of the disc there is formed for each cyclone a recess 4' for receiving an insert 5 wherein the overflow duct 6 is formed. Such an insert is usually called the cover plate of a cyclone. The cover plate 5 may be fixed in any desirable manner whether or not permanently in the recess 4'.

For the supply of the material to be treated to the cyclones there is recessed for each cyclone a supply duct 7 tangentially opening into each cyclone, which duct starts in a cavity 8 which is recessed at the bottom side of the disc 1. The cavity 8 extends about the central passage 4 in the disc and is isolated therefrom by an upright edge 9, while the cavity 8 at the exterior is bonded by a circumferential edge 10. The cavity 8 furthermore communicates with the top side of the disc 1 through at least one eccentric passage 11. In the drawing are depicted in each disc 1 two of such passages 11. The passages 11, during operation of the radial multihydrocyclone, jointly constitute the supply ducts for the material to be treated.

In the top side of each disc there may furthermore be formed a recess 12 wherein fits a projection 13 of the edge 9 at the bottom side, so that the discs in a stack of discs 1 (and 1') are mutually centered. The stack of discs constitutes a column which is entirely closed at the exterior, with the exception of the outlets of the overflows 6 of the individual cyclones. At the inside there is formed a collecting duct for the drain fractions by the communicating central disc passages 4.

The top disc 1' of a column need not have continuous ducts 11, for the hydrocyclones 2 in said disc 1' are the last ones that should be accessible to the material supply. The stack disc 1 (plus 1') rests on a bottom plate 41. Although in principle, with the exception of the upper disc 1', the stack of discs may be composed of completely identical discs 1, the number of which is variable as a matter of fact, it is possible to vary the number of cyclones 2 per each disc 1, as well as the size of the passages 11 in the respective discs. In this manner, e.g. by increasingly narrowing the ducts 11 from the bottom to the top while increasing the number of cyclones 2 from the bottom to the top, a substantially constant flow rate of the material in the entire multihydrocyclone can be ensured.

The discs 1 and 1' in the stack may be mutually fixed and pressed together by means of a rod 15, a cover plate 16 and a nut 16'.

Underneath the bottom 14 having a central opening 17 there is disposed a box 19 separated by a partition 20 in a supply space 21 and a discharge space 22. Through the box 19 extends a sleeve 23 which communicates with the central opening 17.

The stack of discs is surrounded by a housing 24. The space in the housing is in communication through an opening 25 with the discharge space 22. The supply space 21 is fitted with a branch piece 26 and the discharge space 22 with a branch piece 27.

The radial multihydrocyclone according to the invention functions as follows. Via the inlet branch 26 the material to be treated is introduced in the supply space 21. This material flows according to arrows F through the opening 18 in the bottom plate 14 to the first, lower disc 1. While cavity 8 is filled at the bottom side of said disc, the material flow, via passages 11 of the lower disc, reaches cavity 8 at the bottom side of the superimposed disc 1, etc., as far as the upper disc 1'. From the respective cavities 8 at the bottom side of the discs the material flows via the tangential supply ducts 7 in the respective cyclones 2. The overflow fractions leave the cyclones according to the arrow O and via the space between the disc column and the housing 24 and via the openings 25 in the box 19, attain the discharge space 22, so that the overflow fraction can be discharged via branch piece 27.

The drain fraction leaves the respective cyclones via the drain openings 3 and via the central collecting duct formed by the successive central passages 4 of the discs and via the central opening 17 in the bottom 14 reaches the sleeve 23 for further discharge. The drain fraction flows according to arrows A.

I claim:

1. A multihydrocyclone comprising a plurality of at least three stacked discs formed from polyurethane;

means securing and pressing the discs together;

means forming an overflow chamber surrounding the periphery of the discs;

said discs each having (1) a central duct communicating with the central ducts of the other discs with inner edge means of each disc surrounding the central duct and engaging corresponding inner edge means of the adjacent disc or discs such that the central ducts form a common dischage duct extending centrally through the stacked discs, (2) a plurality of cyclone chambers extending radially relative to the central duct with respective inner drain openings thereof opening into the central duct, (3) overflow duct means in the periphery of each disc at the outer ends of the cyclone chambers and forming overflow ducts between the respective cyclone chambers and the overflow chamber, (4) outer edge means at the periphery of the discs engaging corresponding outer edge means of the adjacent disc or discs whereby the stacked discs are closed to the overflow chamber except for the overflow ducts, (5) an annular cavity on at least one side of each disc between the inner and outer edge means forming an input chamber, and (6) tangential supply ducts communicating from the input chamber into the respective cyclone chambers;

means forming an input to one side of a first disc on one end of the stack discs; and all of the discs between the one end of the stacked discs and the disc at the other end of the stack discs each having at least one through passage disposed between the inner and outer edges and communicating between the opposite sides of the discs into the input chambers, and at the first disc, from the input means.

2. A multihydrocyclone as claimed in claim 1 wherein each disc includes a plurality of recesses at the periphery thereof forming extensions of the respective cyclone chambers, and the overflow duct means includes an insert piece in each recess forming the respective overflow duct.

3. A multihydrocyclone as claimed in claim 1 wherein the through passages are formed progressively smaller in accordance with the spacing of the respective disc from the input means.

* * * * *